US005534333A

United States Patent [19]

Keller et al.

[11] Patent Number: 5,534,333

[45] Date of Patent: Jul. 9, 1996

[54] SPIRAL FABRIC

[75] Inventors: Robert A. Keller; William L. Price, III, both of Columbia, S.C.

[73] Assignee: Shakespeare, Columbia, S.C.

[21] Appl. No.: 418,694

[22] Filed: Apr. 7, 1995

[51] Int. Cl.[6] ..... D21F 7/08

[52] U.S. Cl. ..... 428/222; 162/351; 162/900

[58] Field of Search ..... 162/351, 900; 428/222

[56] References Cited

U.S. PATENT DOCUMENTS

| | | | |
|---|---|---|---|
| 4,346,138 | 8/1982 | Lefferts . | |
| 4,351,874 | 9/1982 | Kirby | 428/229 |
| 4,362,776 | 12/1982 | Lefferts et al. | 428/222 |
| 4,381,612 | 5/1983 | Shank | 34/116 |
| 4,392,902 | 7/1983 | Lefferts . | |
| 4,395,308 | 7/1983 | Dawes | 428/222 |
| 4,490,925 | 1/1985 | Smith . | |
| 4,500,590 | 2/1985 | Smith | 428/222 |
| 4,755,420 | 7/1988 | Baker et al. . | |
| 5,217,577 | 6/1993 | Steiner | 428/222 |
| 5,364,692 | 11/1994 | Bowen et al. | 428/222 |

*Primary Examiner*—James C. Cannon
*Attorney, Agent, or Firm*—Donald W. Huntley

[57] ABSTRACT

A spiral fabric comprising a plurality of coils having loops meshed together to form channels at points of overlap between adjacent loops, locking pins positioned in the channels to join adjacent coils to form a mesh, and the improvement wherein a cable structure of at least two thermoplastic filaments is used as at least one component of the fabric.

14 Claims, 3 Drawing Sheets

SPIRAL FABRIC

BACKGROUND OF THE INVENTION

Fabrics made of thermoplastic monofilaments have been used in a wide range of applications. Such fabrics are commonly used in the papermaking industry for transporting and dewatering the aqueous media there found. More broadly, such fabrics are used as filter media for wet, dry, hot and cold solutions and dispersions.

A fabric which includes a plurality of coils formed from a polymeric material is described in Shank, U.S. Pat. No. 4,381,612. The fabric was constructed by joining the coils using pintle or joint means, and the loops of the coils were filled by means of a single end monofilament, cabled monofilament, or multifilament yarn. The individual coil links were constructed from a thermoplastic such as a polyester monofilament in order have sufficient elasticity. Spiral fabrics are also disclosed in U.S. Pat. No. 4,395,308 for use as papermaker's fabric. These spiral fabrics were constructed by intermeshing spiral coils which were then joined by a pintle pin or hinge which was inserted between the intermeshed coils to hold them together. These pins have in the past, been prepared from metal and thermoplastic monofilament.

The permeability of spiral fabrics can be controlled by the thickness of the side lengths of the spiral wire and the thickness at the curved ends. Thus, if the wire thickness is greater or broader at the side lengths than the wire thickness at the curved ends, then a larger contact surface and hence a lower permeability fabric is obtained. Permeability of these fabrics can be further reduced by introducing filler materials into the spaces of the spiral fabric.

While the development of spiral fabrics has represented a significant advance in the field, the use of monofilament spiral fabrics in certain applications requires greater abrasion resistance than has heretofore been attainable using thermoplastic filaments.

SUMMARY OF THE INVENTION

The present invention provides a spiral fabric which exhibits greater resistance to abrasion than has previously been available.

Specifically, the present invention provides, in a spiral fabric comprising a plurality of coils extending in a common direction, the coils meshed together to form channels at points of overlap between adjacent coils, and locking pins positioned in the channels joining adjacent coils successively together forming a fabric mesh, the improvement wherein either the coil or locking pin comprises a cable structure of at least two thermoplastic filaments, each filament having a cross-sectional shape that is bilaterally symmetrical and fused to at least one adjacent filament along about from 1 to 100% of its perimeter.

DETAILED DESCRIPTION OF THE INVENTION

The spiral fabrics of the present invention are prepared by joining a plurality of coils together using a locking pin.

In general terms, in the preparation of spiral fabrics, coils or helixes are produced by unwinding monofilament yarn, under tension, from a spool and then cold-forming the yarn by winding it onto a mandrel. The monofilament then is passed through one or more heated zones which set the yarn into the coiled shape. Both clockwise and counterclockwise coils are produced. Coils are collected and transported to an assembly table for fabric assembly.

At the assembly table, two or more coils are interlaced, the pintle pins are inserted into the interstices formed by the interlacing, and the resultant unfinished fabric is cut to its approximate width. A yarn may be inserted into the hollow center of the coil to control the air permeability of the fabric. This yarn is referred to as a filler or stuffer yarn. The fabric is then heatset to provide some crimp, flatten the coils, and smooth out the thermal properties of the fabric. Following heatsetting, the fabric is cut to final width and the edges are sealed.

Figure 1:
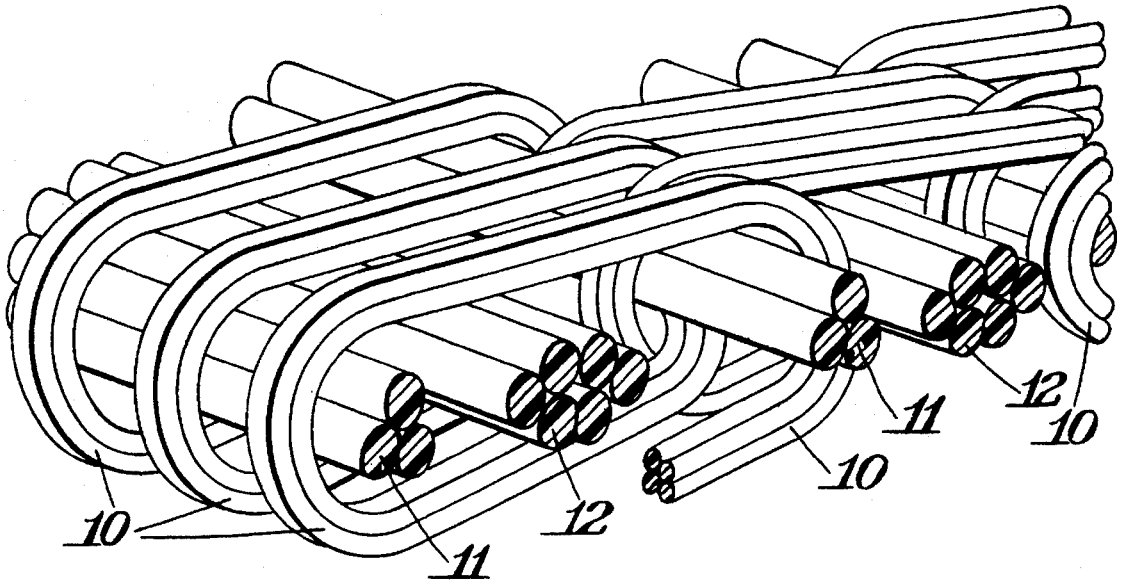
FIG. 1 is a perspective view of a spiral fabric of the present invention.
Figure 1A:
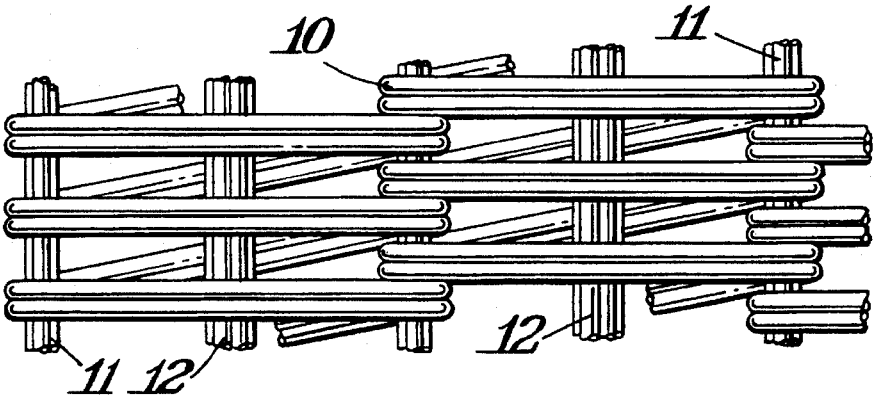
FIG. 1A is a plan view of the fabric of FIG. 1.
Figure 2:
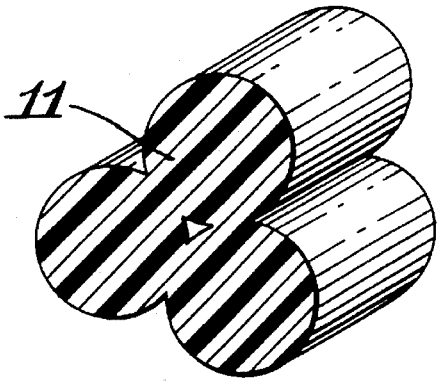
FIGS. 2–4 are cross-sectional views of representative cable structures which can be used in the present invention.

A representative fabric is illustrated in FIG. 1, which comprises a plurality of coils 10 extending in a common direction, the coils meshed together to form channels at point of overlap between adjacent loops of the coils. Locking pins or pintles 11 are positioned in the channels adjoining adjacent coils, forming a fabric mesh. In this Figure, the successive coils are elongated, to forming interstices between the joint means, which are here filled by filler or stuffer material 12. In the Figure, coils 10 are prepared from four-filament cable, as shown more clearly in FIG. 3, pintles 11 are prepared from three-filament cable, as shown more clearly in FIG. 2, and the filler material 12 is six-filament cable, as shown more clearly in FIG. 4.

The coils can be made from a variety of thermoplastic filaments or cable structure of at least two thermoplastic filaments. The coils extend in a common direction forming loops. These loops are meshed together to form channels at points of intersection of the coils.

In accordance with the present invention, at least one of the coils, the pintles or locking pins and, if present, the filler material, comprise a cable structure as herein defined. These cable structures comprise at least two thermoplastic polymeric filaments, each filament having a cross sectional shape which is bilaterally symmetrical and fused to at least at one adjacent filament along about from 1 to 100% of its perimeter.

The filaments of the cable structure can be prepared from a wide variety of thermoplastic polymers such as polyesters and polyamides. Representative polyesters which can be used include polyethylene terephthalate, polybutylene terephthalate, and poly(cyclohexanedimethylene terephthalateisophthalate) (PCTA). Representative polyamides which can be used include cyclic, aromatic and aliphatic polyamides, copolymers of polyamides of fiber-forming molecular weight having a relative viscosity generally between about 25 and 270 as determined by ASTM D-789. These polyamides include, for example, poly(caprolactam) (nylon 6), cyclic polyamides, poly(undecanoamide) (nylon 11) poly(hexamethyleneadipamide) (nylon 66), poly(hexamethylenedecanoamide) (nylon 610), and poly(hexamethylenedodecanoamide) (nylon 612). Polyamide copolymers and polymer blends can also be used such as those prepared from nylon 6 and nylon 66, and nylon 11. Of these polyamides, nylon 66 and nylon 610 and nylon 6 have been found to be particularly satisfactory for use in paper machine clothing. For those applications that involve high temperature applications, polyphenylene sulfide (PPS), PCTA and polyether ether ketone are preferred.

The polymers can, as will be recognized by those skilled in the art, contain a wide variety of additives typically used in the preparation of monofilaments to modify the appearance and performance characteristics, such as anti-oxidants, dyes, pigments, anti-static agents and ultraviolet stabilizers.

The filament structures are prepared by extruding, through a die, at least two individual filaments of thermoplastic polymer around a single axis. The structures used in the present invention generally comprise from 2–48 component filaments, and preferably at least three filaments. Those structures having from 3 to 24 filaments have been found to be particularly satisfactory.

Figure 3:
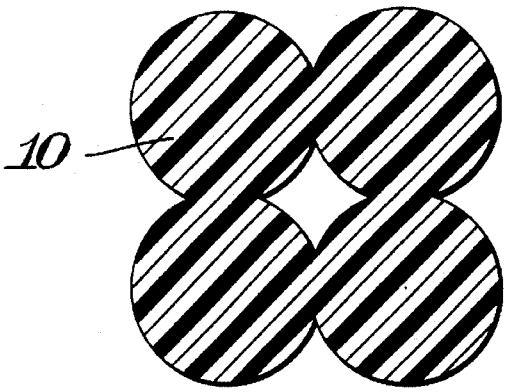
Figure 4:
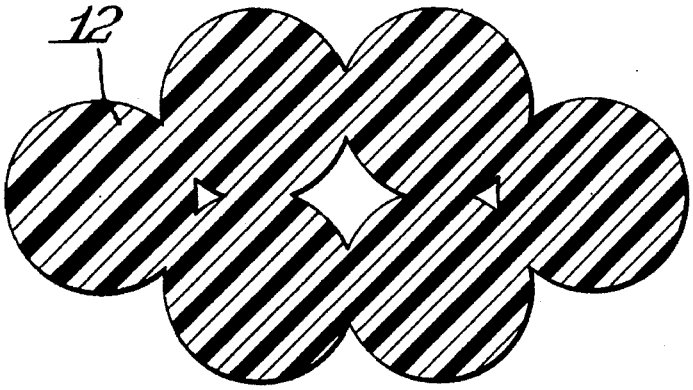

The filaments that make up the present cable structures are arranged about a single axis. That axis can itself be a filament or a void. The arrangement illustrated in FIG. 2, which is a cross-sectional view of a cable structure, shows a cable having a clover shaped cross-section with three filaments and central void. FIG. 3 shows a similar arrangement with four filaments, resulting in a central void. FIG. 4 illustrates a cable structure having six filaments.

The diameter of the individual filaments from which the present cable structures are prepared can vary widely, depending on the particular application. In general, however, each component filament will have a diameter of about from 1 to 50 mils. While the individual filaments are generally the same size, the cable structures can also include various diameters or shapes within one structure.

Figure 5:
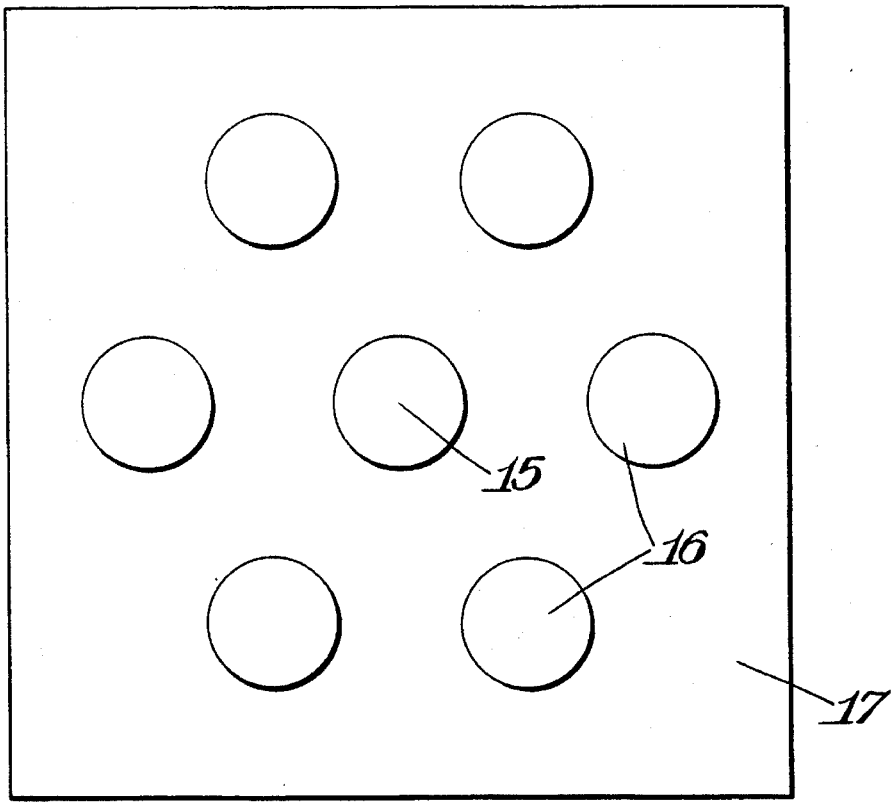
FIGS. 5 and 6 are planar views of extrusion dies that can be used for the preparation of cable structures useful in the present invention.
Figure 6:
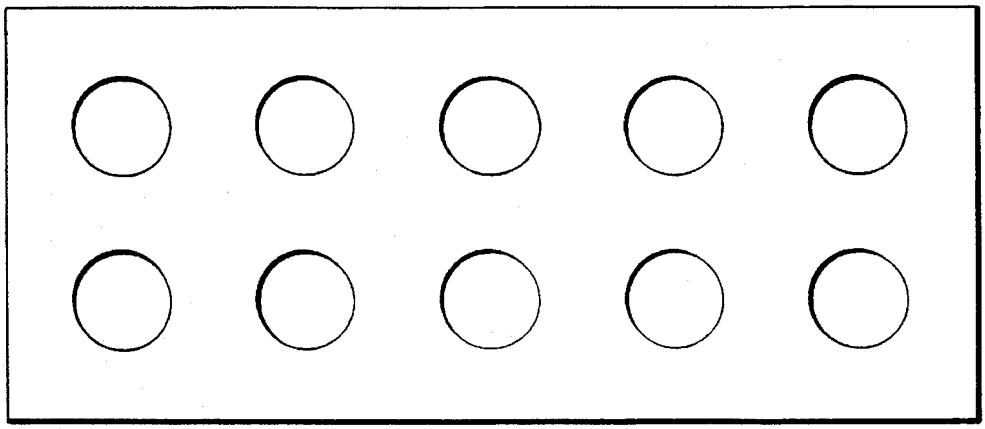

The cable structures which are used in the fabrics are prepared by extrusion through a die corresponding to the number of filaments and configurations desired in the structure. Representative dies are shown in FIGS. 5 and 6, which are plan views of dies for extruding cable composed of 4 and 8 filaments, respectively.

In the preparation of the cables used in the present structure, the polymer swells upon exit from the spinnerette. The individual filaments fuse or bond together through the die swell, while still in a molten or plastic state, to at least one adjacent filament using conventional extrusion practices. The extent of the fusion of each filament with at least one adjacent filament will vary with the cross-sectional shape, diameter and polymer type of the filament as well as the configuration of the resultant yarn structure, and generally will be about from 1 to 100% of the perimeter. The resultant structure is then passed into a quench medium such as water, after which it is oriented by drawing. While the particular draw ratio will necessarily depend on the specific polymer used, typically a monofilament is drawn 3 to 7 times the original length of the monofilament, and preferably about from 3.5 to 5 times its original length. The drawing can be carried out in multiple stages, and is generally carried out in two or three stages for optimum performance characteristics. This drawing, carried out at the known orientation temperature of the polymer, results in marked improvements in the physical and thermal properties of the filaments, as well recognized by those skilled in the art.

The present fabrics, comprising cable structure as herein defined as at least one of the coils, pintles or stuffer, exhibits improved abrasion resistance over spiral fabric prepared from round thermoplastic monofilament. The improvement in abrasion resistance is particularly noticeable when the cable is used for at least part of the coils in the fabric. Compared with round monofilament, the use of the cable as the coil material in a spiral fabric will at least double abrasion resistance for a comparable denier filament.

The present invention is further illustrated by the following examples. In these examples, the filaments were tested in a squirrel cage apparatus which consisted of twelve equally spaced carbon steel bars in a cylindrical configuration. The bars had a diameter of 3.1 mm and a length of 60.5 cm, and the cage diameter was 26.0 cm. In the course of the test, the cage was rotated at 160 rpm, with the test filament draped over the cage with a 500 gram weight at the end. In the course of testing, at least five samples of the test filament are cut, having a length long enough to go over the cage, but not so long as to permit the weights at the ends of the test lines to drag on the base. The end of each test filament not attached to the weight is attached to a hook at the rear of the machine. The test filaments are draped to extend over the cage, and positioned at 160 rpm and the cycles to break during the course of the test are determined. When tested comparatively with single and round monofilaments of the same denier, the cable structure surprisingly out performed the round structure by at least 2 to 1.

EXAMPLES 1–4

In Examples 1 and 2, nylon 6 was melt extruded through a spinnerette having three apertures formed therein, each having a diameter of 0.039". The apertures were uniformly placed around a center axis in the die face. The apertures were spaced from the adjacent apertures by a center to center distance of 0.042 and 0.044 inches in Examples 1 and 2, respectively. The filaments were extruded at temperatures of from 490° to 520° F. After exiting from the die face, each of the three filaments was fused through die swell to its two adjacent component filaments along about 30% of its perimeter. The resultant structure was then passed into a quench bath maintained at approximately 80° F. The quench bath was approximately 1.5 inches below the die orifice.

The resulting cable structures were then oriented by drawing in two stages to 4.35 times their original length. Inspection of a cross section of the drawn structure confirmed that each fused filament in the structure had a substantially circular cross sectional shape.

In Examples 3 and 4, the general procedure of Example 1 was repeated, except that four and eight filaments were used to make up the cable by extruding through dies having aperture patterns as shown on FIGS. 5 and 6, respectively.

In each Example, the cable is used as the locking pin in a spiral fabric, in combination with coils of oriented nylon 6 monofilament having a diameter of about 0.7 mm.

EXAMPLES 5 to 8

In Examples 5 to 8, the general procedure of Examples 1 to 4 was repeated, except that the cable structures were used as the coils in the spiral fabric.

EXAMPLES 9 to 12

The general procedure of Examples 1 to 4 was repeated, except that the cable was used in the preparation of a spiral fabric as the filler material.

EXAMPLE 13

A monofilament yarn, consisting of four component ends in a square configuration and having a cross sectional dimension of 0.7 mm, is coiled in the manner well known in the art and discussed above. The finished coils possess a height of 3.8 mm +/–0.1 mm and a width of 6.4 mm +/– 0.1 mm.

The coils are then moved to an assembly table where six coils are interlaced at one time and the pintle pins are inserted. Each pintle pin, consisting of a monofilament of three component ends in a triangular configuration and having a cross sectional dimension of 0.9 mm, is fed through the interstice formed by the interlaced coils. While the fabric is being assembled, a stuffer yarn, consisting of six component ends in an octagonal configuration and having a width of 2.03 mm and a thickness of 0.64 mm, is inserted into the hollow center of the coil. The fabric is then cut to approximate length, heatset, and sealed in the customary manner.

We claim:

1. In a spiral fabric comprising a plurality of coils extending in a common direction, the coils having loops meshed together to form channels at points of contact between adjacent loops, and locking pins positioned in the channels joining adjacent coils successively together forming a fabric mesh, the improvement wherein at least one of the coils and the locking pins comprises a cable structure of at least two thermoplastic filaments, each filament having a cross-sectional shape that is bilaterally symmetrical and fused to at least one adjacent filament along about from 1 to 100% of its perimeter.

2. A spiral fabric of claim 1 wherein the cable structure comprises at least one of polyester or polyamide.

3. A spiral fabric of claim 2 wherein the cable structure consists essentially of polyester.

4. A spiral fabric of claim 2 wherein the cable structure consists essentially of polyamide.

5. A spiral fabric of claim 1 wherein the cable structure is molecularly oriented by drawing at least about from 3 to 7 times the original length of the cable.

6. A spiral fabric of claim 1 wherein the cable structure comprises 2 to 48 filaments.

7. A spiral fabric of claim 1 wherein the cable structure comprises at least 3 filaments.

8. A spiral fabric of claim 7 wherein the cable structure comprises 3 to 24 filaments.

9. A spiral fabric of claim 1 wherein the cable structure comprises at least 4 filaments.

10. A spiral fabric of claim 1 wherein the cable structure comprises 8 filaments.

11. A spiral fabric of claim 1 wherein the filaments have a substantially clover shaped cross-sectional configuration.

12. A spiral fabric of claim 1 wherein the filaments have a substantially octagonal cross-sectional configuration.

13. A spiral fabric of claim 1 wherein the locking pin and the runs of the loops define interstices, which are at least partially filled with a filler material in the interstices.

14. A spiral fabric of claim 13 wherein the filler material consists of a cable structure comprising at least two thermoplastic filaments, each filament having a cross-sectional shape that is bilaterally symmetrical and fused to at least one adjacent filament along about 1–100% of its perimeter.

* * * * *